US005542553A

United States Patent [19]

Penniman

[11] Patent Number: 5,542,553

[45] Date of Patent: Aug. 6, 1996

[54] LADDER CADDY

[76] Inventor: William E. Penniman, 1052 McKinney Ave., Havre, Mont. 59501

[21] Appl. No.: 355,618

[22] Filed: Dec. 14, 1994

[51] Int. Cl.[6] ..... A47F 7/00

[52] U.S. Cl. ..... 211/70.6; 182/129

[58] Field of Search ..... 211/70.6, 71, 86, 211/88; 248/210, 238, 211; 182/129

[56] References Cited

U.S. PATENT DOCUMENTS

| | | | |
|---|---|---|---|
| D. 304,084 | 10/1989 | Meng . | |
| 3,684,102 | 8/1972 | Colter | 211/88 |
| 3,979,097 | 9/1976 | Balne . | |
| 4,120,472 | 10/1978 | Balne . | |
| 4,356,854 | 11/1982 | McGee | 182/129 X |
| 4,624,430 | 11/1986 | Ehmke . | |
| 4,653,713 | 3/1987 | Hamilton | 182/129 X |
| 4,706,918 | 11/1987 | Wilson | 182/129 X |
| 4,730,802 | 3/1988 | Chatham et al. | 182/129 X |
| 5,123,620 | 6/1992 | Bourne . | |
| 5,236,161 | 8/1993 | Haven | 182/129 X |

*Primary Examiner*—Alvin C. Chin-Shue
*Assistant Examiner*—Sarah L. Purol

[57] ABSTRACT

A ladder caddy comprising a housing formed with a generally vertical side wall, a container mechanism coupled to a central extent of the side wall for holding tools therein, and a handle mechanism coupled to and extended upwards from the side wall; and a coupling mechanism for removably coupling the side wall to the legs of a ladder.

7 Claims, 3 Drawing Sheets

LADDER CADDY

BACKGROUND OF THE INVENTION

1. Field of the Invention

The present invention relates to a ladder caddy and more particularly pertains to supporting the tools of workmen in a convenient position on a ladder with a ladder caddy.

2. Description of the Prior Art

The use of devices of a wide variety, designs and configurations for supporting objects in a common location for transportation and use is known in the prior art. More specifically, devices of a wide variety, designs and configurations for supporting objects in a common location for transportation and use heretofore devised and utilized for the purpose of maintaining tools or other objects together by a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 304,084 to Meng which discloses a ladder caddy. U.S. Pat. No. 3,979,097 to Balne discloses a ladder caddy. U.S. Pat. No. 4,120,472 to Balne discloses a ladder caddy with rung catch means. U.S. Pat. No. 4,624,430 to Ehmke which discloses a ladder caddy. U.S. Pat. No. 5,123,620 to Bourne which discloses an accessory container for a ladder.

While these devices fulfill their respective, particular objective and requirements, the aforementioned patents do not describe a ladder caddy that holds tools and materials in a position for ready access when using a ladder.

In this respect, the ladder caddy according to the present invention substantially departs from the conventional concepts and designs of the prior art, and in doing so provides an apparatus primarily developed for the purpose of supporting the tools of workmen in a convenient position on a ladder.

Therefore, it can be appreciated that there exists a continuing need for new and improved ladder caddy which can be used for supporting the tools of workmen in a convenient position on a ladder. In this regard, the present invention substantially fulfills this need.

SUMMARY OF THE INVENTION

In the view of the foregoing disadvantages inherent in the known types of devices of a wide variety, designs and configurations for supporting objects in a common location for transportation and use now present in the prior art, the present invention provides an improved ladder caddy. As such, the general purpose of the present invention, which will be described subsequently in greater detail, is to provide a new and improved ladder caddy and method which has all the advantages of the prior art and none of the disadvantages.

To attain this, the present invention essentially comprises, in combination, a housing. The housing includes a generally rectangular vertical interior side wall having long parallel horizontal upper and lower edges and short vertical end edges interconnected therebetween. The housing includes a generally rectangular vertical exterior side wall offset from and positioned in parallel with the interior side wall and with the exterior side wall having long parallel horizontal upper and lower edges and short vertical end edges interconnected therebetween and with the end edges of the exterior wall being shorter than the end edges of the interior wall. The housing includes a pair of generally rectangular vertical end walls each having parallel horizontal upper and lower edges and parallel vertical end edges interconnected therebetween. Each end wall has one end edge coupled with a separate end edge of the exterior side wall such that the lower edges of the interior side wall, exterior side wall, and end walls are positioned in a first common plane and the upper edges of the end walls and exterior side wall are positioned in a second parallel common plane located above the first common plane and beneath the upper edge of the interior side wall. Each end wall has its other end edge coupled to the interior side wall. The housing includes a generally rectangular horizontal lower wall positioned in the first common plane and having long parallel horizontal interior and exterior edges and short parallel horizontal end edges and with the end edges thereof coupled with the lower edges of the end walls, the exterior edge thereof coupled with the lower edge of the exterior side wall, and the interior edge thereof coupled with the lower edge of the interior side wall to form a container with a box-shaped hollow interior portion. The housing includes a generally rectangular vertical dividing wall having parallel horizontal upper and lower edges and parallel vertical interior and exterior edges interconnected therebetween with the dividing wall disposed within the container with the exterior edge thereof coupled to the exterior side wall, the interior edge thereof coupled to the interior side wall, the lower edge thereof coupled to the lower wall, and the upper edge thereof positioned within the second common plane. The dividing wall thereby creates two equally-sized bins within the container for holding tools. Lastly, the housing includes an upstanding central region extended from the upper edge of the interior wall with the central region having an oblong recess formed therethrough to create a carrying handle.

A pair of C-shaped brackets are provided. Each bracket has an exterior wall pivotally coupled to the interior side wall adjacent to one of its end edges. Each bracket further includes an interiorly extending region adapted to be secured to a separate leg of a ladder.

A horizontally extending first plate is included and secured to and extended outwards from a central extent of the interior side wall above the container. The first plate had a plurality of circular apertures therethrough for receiving screwdrivers and a plurality of elongated slots therethrough for receiving pliers and cutters. A horizontally extending second plate is also included and secured to and extended outwards from the interior side wall. The second plate has an elongated recess formed thereon with an aperture extending centrally therethrough to create a hammer holder for receiving a hammer. An L-shaped wall is also included and has long upper and lower L-shaped edges and short vertical end edges with one end edge coupled to the end edge of the interior side wall and the other end edge coupled to the end wall to create a drill pocket located on a side of the container opposite the hammer holder for receiving a drill. Lastly, a pair of spaced parallel feet are included and extend downwardly from the lower wall of the container for allowing the ladder caddy to be set on a recipient surface. The ladder caddy is fabricated of a high-impact resistant plastic material.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder caddy which has all the advantages of the prior art devices of a wide variety, designs and configurations for supporting objects in a common location for transportation and use and none of the disadvantages.

It is another object of the present invention to provide a new and improved ladder caddy which may be easily and efficiently manufactured and marketed.

It is a further object of the present invention to provide a new and improved ladder caddy which is of durable and reliable construction.

An even further object of the present invention is to provide a new and improved ladder caddy which is susceptible of a low cost of manufacture with regard to both materials and labor, and which accordingly is then susceptible of low prices of sale to the consuming public, thereby making such a ladder caddy economically available to the buying public.

Still yet another object of the present invention is to provide a new and improved ladder caddy which provides in the apparatuses and methods of the prior art some of the advantages thereof, while simultaneously overcoming some of the disadvantages normally associated therewith.

Even still another object of the present invention is to provide a new and improved ladder caddy for supporting the tools of workmen in a convenient position on a ladder.

Lastly, it is an object of the present invention to provide a new and improved ladder caddy comprising a housing formed with a generally vertical side wall, container means coupled to a central extent of the side wall for holding tools therein, and handle means coupled to and extended upwards from the side wall; and coupling means for removably coupling the side wall to the legs of a ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
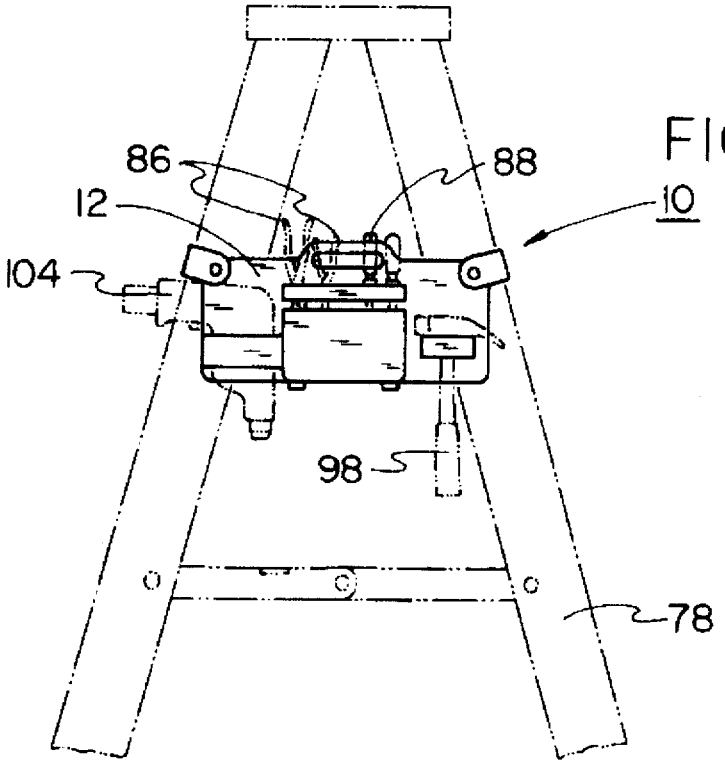
FIG. 1 is a side-elevational view of the preferred embodiment of the new and improved ladder caddy constructed in accordance with the principles of the present invention.
Figure 2:
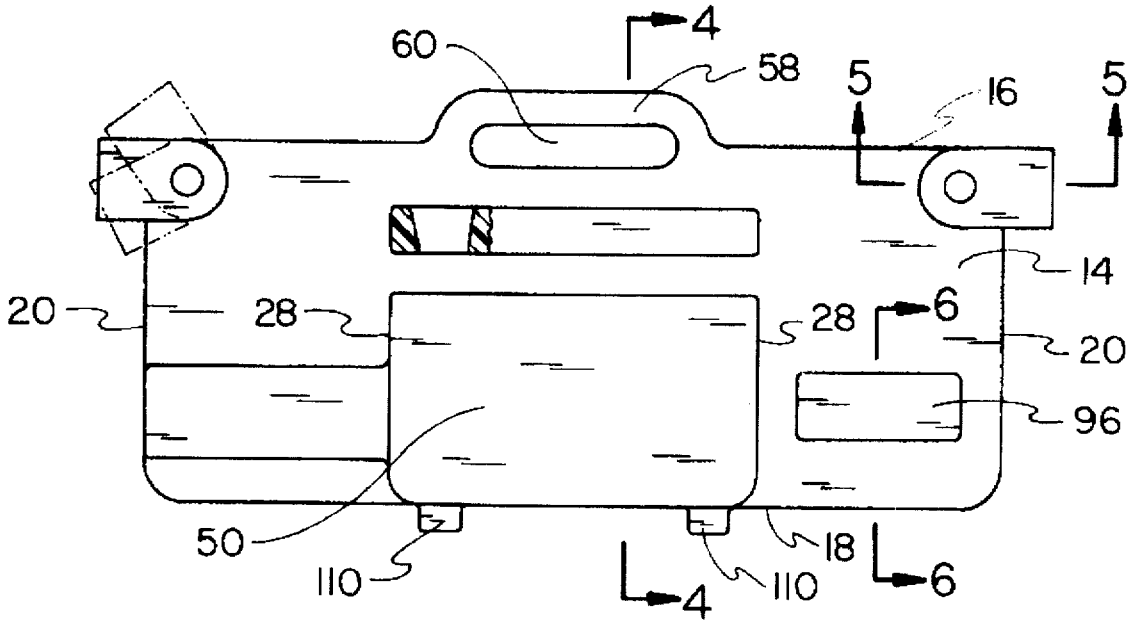
FIG. 2 is an enlarged side-elevational view similar to FIG. 1 but with parts shown in cross-section.
Figure 3:
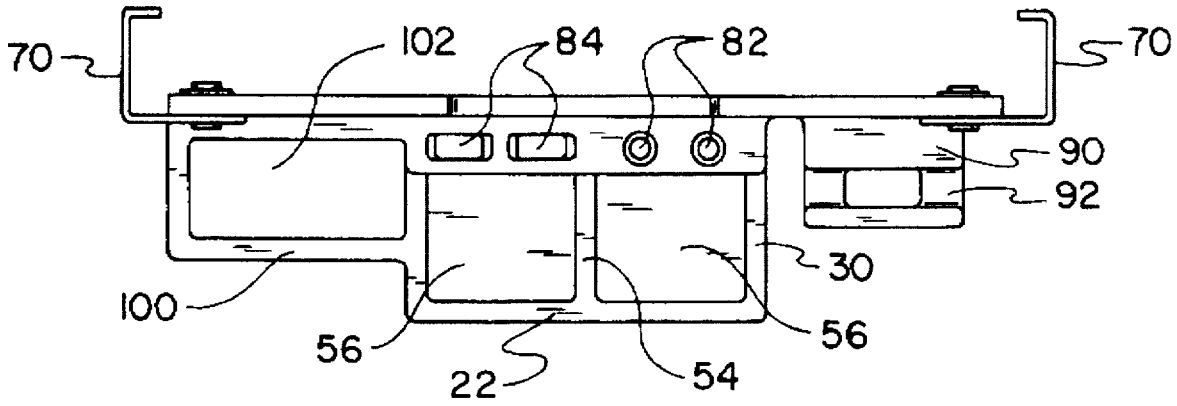
FIG. 3 is a top view of the device illustrated in FIGS. 1 and 2.
Figure 4:
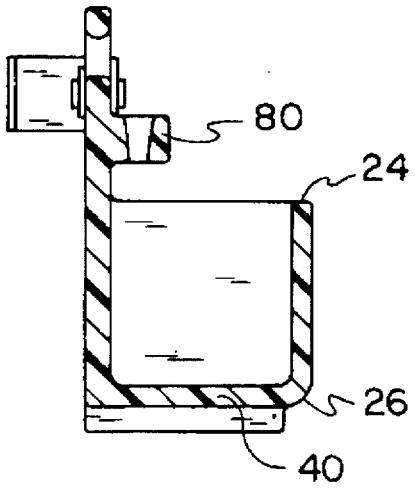
FIG. 4 is a cross-sectional view taken along the line 4—4 of FIG. 2.
Figure 5:
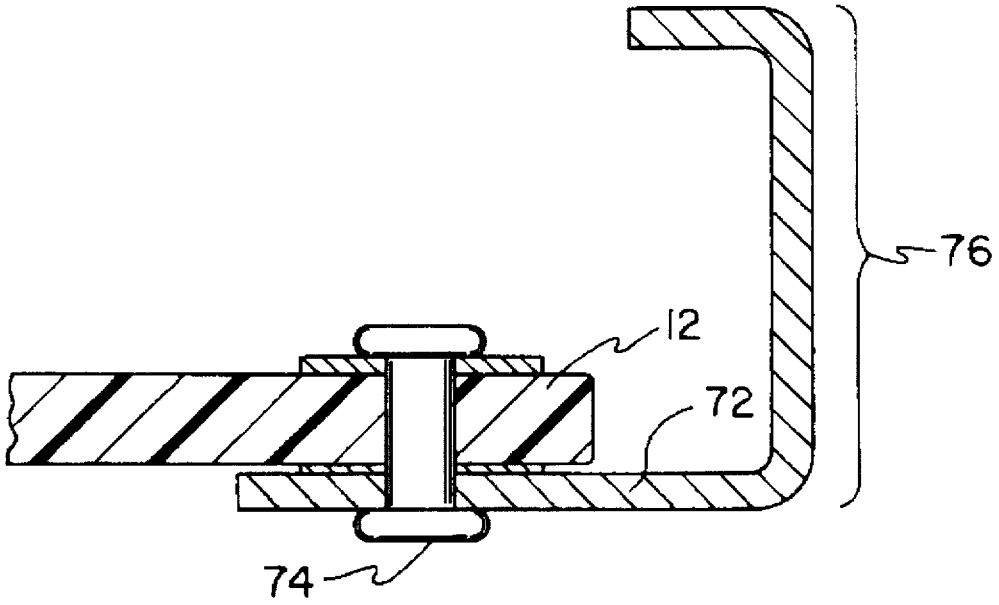
FIG. 5 is a cross-sectional view taken along the line 5—5 of FIG. 2.
Figure 6:
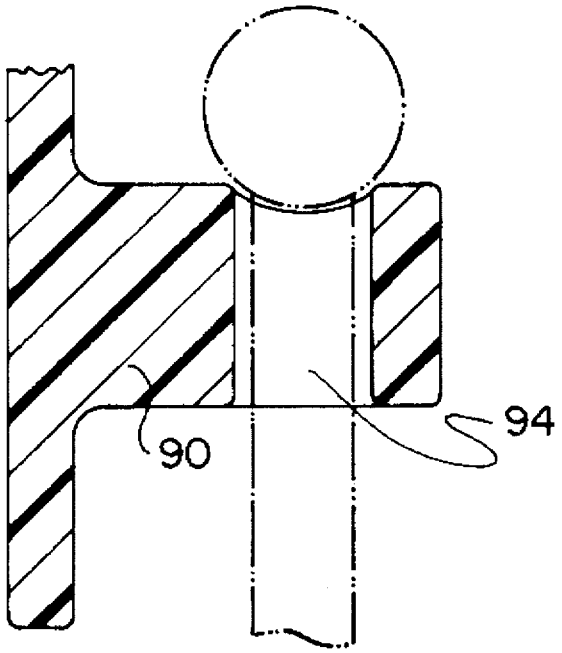
FIG. 6 is a cross-sectional view taken along the line 6—6 of FIG. 2.

With reference now to the drawings, and in particular, to FIG. 1 thereof, the preferred embodiment of the new and improved ladder caddy embodying the principles and concepts of the present invention and generally designated by the reference number 10 will be described.

The present invention is comprised of a plurality of components. In their broadest context, such components include a housing, brackets, plates, and feet. Such components are individually configured and correlated with respect to each other to provide the intended function of holding tools and related materials at a position for ready access when using a ladder.

Specifically, the ladder caddy includes a housing 12. The housing includes a generally rectangular and vertically positioned interior side wall 14. The interior side wall is rigid in structure and has long parallel horizontal upper and lower edges 16, 18 and short vertical end edges 20 interconnected therebetween. The housing also includes a generally rectangular and vertically positioned exterior side wall 22. The exterior side wall is offset from and positioned in parallel with the interior side wall. The exterior side wall is rigid in structure and has long parallel horizontal upper and lower edges 24, 26 and short vertical end edges 28 interconnected therebetween. The end edges of the exterior wall are shorter than the end edges of the interior wall. Furthermore, the long edges of the exterior wall are shorter than the long edges of the interior wall. The housing also includes a pair of generally rectangular and vertically positioned end walls 30. The end walls are aligned in parallel and offset from each other. Each end wall is rigid in structure and has parallel horizontal upper and lower edges and parallel vertical end edges interconnected therebetween. Each end wall has one end edge coupled with a separate end edge of the exterior side wall such that the lower edges of the interior side wall, exterior side wall, and end walls are positioned in a first common plane. Furthermore, this coupling ensures that the upper edges of the end walls and the exterior side wall are positioned in a second parallel common plane located above the first common plane and beneath the upper edge of the interior side wall. Each end wall has its other end edge coupled to the interior side wall. The housing also includes a generally rectangular and horizontally positioned lower wall 40. This lower wall is positioned in the first common plane and is bounded by the end walls and exterior side wall. The lower wall is rigid in structure and has long parallel horizontal interior and exterior edges and short parallel horizontal end edges interconnected therebetween. The end edges thereof are coupled with the lower edges of the end walls. The exterior edge of the lower wall is coupled with the lower edge of the exterior side wall. Furthermore, the interior edge of the lower wall is coupled with the lower edge of the interior side wall. This coupling of the edges with the edges of the end walls and interior and exterior side walls forms a container 50 having a box-shaped hollow interior portion with an open top. The housing also includes a generally rectangular and vertically positioned dividing wall 54. The dividing wall is rigid in structure and has parallel horizontal upper and lower edges and parallel vertical interior and exterior edges interconnected therebetween. The dividing wall is disposed within the container with its exterior edge coupled to the exterior side wall, its interior edge coupled to the interior side wall, and its lower edge coupled to the lower wall such that its upper edge is positioned within the second common plane. This coupling thereby creates two equally-sized bins 56 within the container. These bins are used for holding tools, materials, and the like. The housing also includes an upstanding central region 58. This central region is extended from the upper edge of the interior wall. The central region has an oblong recess 60 formed therethrough to create a carrying handle for allowing a user a firm grip of the ladder caddy.

A pair of C-shaped brackets 70 are also provided. Each bracket has an exterior wall 72 pivotally coupled to the interior side wall at a location adjacent to one of its end edges. This pivotal coupling is performed with a pin 74. Each bracket further has an interiorly extended region 76. This extending region is adapted to be secured to a separate leg 78 of a ladder for holding the housing in a stationary position.

The present invention also includes a horizontally extended first plate 80. The first plate is rigid in structure and secured to and extended outwards from a central extent of the interior side wall at a location above the container 50. The first plate has a plurality of circular apertures 82 formed therethrough for receiving screwdrivers. The first plate also has a plurality of elongated slots 84 formed therethrough for receiving pliers 86, cutters 88, and the like.

Also provided is a horizontally extending second plate 90. The second plate is rigid in structure and secured to and extended outwards from the interior side wall. The second plate has an elongated recess 92 formed thereon with an aperture 94 extending centrally therethrough to create a hammer holder 96. The hammer holder is adapted for receiving a hammer 98.

Also provided is an L-shaped wall 100. This L-shaped wall has long upper and lower L-shaped edges and short vertical end edges. One end edge of the L-shaped wall is coupled to the end edge of the interior side wall. The other end edge of the L-shaped wall is coupled to the end wall. This coupling creates a drill pocket 102 located on a side of the container opposite the hammer holder 96. The drill pocket is used for receiving a drill 104.

To support the invention on a recipient surface, a pair of spaced parallel feet 110 are provided. The feet are extended downwardly from the lower wall of the container 50. Thus, the ladder caddy can be used in a stand-alone mode on a recipient surface with support provided by its feet or in a hanging mode with support provided through its brackets.

The present invention is an adaptation of the common carpenter pouch for use on a ladder as a tool and material organizer. It hooks over the ladder legs when the ladder is in an open position for storage of drills, miscellaneous tools, and nails, screws, and the like. The present invention is made from plastic, metal, leather, or a combination thereof. In the preferred embodiment, the ladder caddy is fabricated of a high-impact resistant plastic material. The length of the present invention is about 15 inches and its height is about 6 to 8 inches. The present invention is especially useful to carpenters, plumbers, electricians and do-it-yourselfers. The present invention resolves the problem of positioning tools and materials in a position for ready access when using a ladder.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A ladder caddy for supporting tools of workmen in a convenient position on a ladder comprising, in combination:

a housing formed with a generally rectangular vertical interior side wall having long parallel horizontal upper and lower edges and short vertical end edges interconnected therebetween, a generally rectangular vertical exterior side wall offset from and positioned in parallel with the interior side wall and with the exterior side wall having long parallel horizontal upper and lower edges and short vertical end edges interconnected therebetween and with the end edges of the exterior wall being shorter than the end edges of the interior wall, a pair of generally rectangular vertical end walls each having parallel horizontal upper and lower edges and parallel vertical end edges interconnected therebetween, each end wall having one end edge coupled with a separate end edge of the exterior side wall such that the lower edges of the interior side wall, exterior side wall, and end walls are positioned in a first common plane and the upper edges of the end walls and exterior side wall are positioned in a second parallel common plane located above the first common plane and beneath the upper edge of the interior side wall, each end wall having its other end edge coupled to the interior side wall, a generally rectangular horizontal lower wall positioned in the first common plane and having long parallel horizontal interior and exterior edges and short parallel horizontal end edges and with the end edges thereof coupled with the lower edges of the end walls, the exterior edge thereof coupled with the lower edge of the exterior side wall, and the interior edge thereof coupled with the lower edge of the interior side wall to form a container with a box-shaped hollow interior portion, a generally rectangular vertical dividing wall having parallel horizontal upper and lower edges and parallel vertical interior and exterior edges interconnected therebetween with the dividing wall disposed within the container with the exterior edge thereof coupled to the exterior side wall, the interior edge thereof coupled to the interior side wall, the lower edge thereof coupled to the lower wall, and the upper edge thereof positioned within the second common plane, the dividing wall thereby creating two equally-sized bins within the container for holding tools, and an upstanding central region extended from the upper edge of the interior wall and having an oblong recess formed therethrough to create a carrying handle;

a pair of C-shaped brackets, each bracket having an exterior wall pivotally coupled to the interior side wall adjacent to one of its end edges, each bracket further having an interiorly extending region adapted to be secured to a separate leg of a ladder;

a horizontally extending first plate secured to and extended outwards from a central extent of the interior side wall above the container and having a plurality of circular apertures therethrough for receiving screwdrivers and a plurality of elongated slots therethrough for receiving pliers and cutters;

a horizontally extending second plate secured to and extended outwards from the interior side wall and having an elongated recess formed thereon with an aperture extending centrally therethrough to create a hammer holder for receiving a hammer;

an L-shaped wall having long upper and lower L-shaped edges and short vertical end edges with one end edge coupled to the end edge of the interior side wall and the other end edge coupled to the end wall to create a drill pocket located on a side of the container opposite the hammer holder for receiving a drill;

a pair of spaced parallel feet extending downwardly from the lower wall of the container for allowing the ladder caddy to be set on a recipient surface; and wherein the ladder caddy is fabricated of a high-impact resistant plastic material.

2. A ladder caddy comprising:

a housing formed with a generally vertical sidewall, container means coupled to a central extent of the sidewall for holding tools therein, and handle means coupled to and extended upwards from the side wall; and coupling means for removably coupling the side wall to the legs of a ladder the coupling means comprising a pair of spaced C-shaped brackets with each bracket having an exterior wall pivotally coupled to the side wall by means of a pin, each bracket further having an interiorly extending region adapted to be secured to a separate leg of a ladder.

3. The ladder caddy as set forth in claim 2 further including a first holding means secured to and extended outwards from the side wall at a location above the container for receiving and holding tools.

4. The ladder caddy as set forth in claim 3 further including a second holding means secured to and extended outwards from the side wall for receiving and holding a hammer.

5. The ladder caddy as set forth in claim 2 further including pocket means coupled between the sidewall and the container means for receiving and holding a drill.

6. The ladder caddy as set forth in claim 2 further including a plurality of feet extending downwardly from the container for allowing the ladder caddy to be set on a recipient surface.

7. The ladder caddy as set forth in claim 2 further wherein the ladder caddy is fabricated of a high-impact resistant plastic material.

* * * * *